United States Patent [19]

Bobkova et al.

[11] 4,256,487

[45] Mar. 17, 1981

[54] PROCESS FOR PRODUCING VANADIUM-CONTAINING ALLOYS

[76] Inventors: Olga S. Bobkova, 3 Rybinskaya ulitsa, 21, Korpus 2, kv. 212; Nikolai P. Slotvinsky-Sidak, Ambulatorny pereulok, 17, kv. 54; Oleg V. Travin, Pervomaiskaya ulitsa, 73, kv. 83; Averky A. Frolov, Leningradsky prospekt, 14, kv. 16, all of Moscow, U.S.S.R.

[21] Appl. No.: 948,652

[22] Filed: Oct. 3, 1978

Related U.S. Application Data

[63] Continuation of Ser. No. 792,306, Apr. 29, 1977, abandoned, which is a continuation of Ser. No. 554,542, Mar. 3, 1975, abandoned.

[51] Int. Cl.[3] ..... C22C 27/02

[52] U.S. Cl. ..... 75/134 V; 75/84; 75/135

[58] Field of Search ..... 75/135, 134 V, 84, 123 J

[56] References Cited

U.S. PATENT DOCUMENTS

| | | | |
|---|---|---|---|
| 858,329 | 6/1907 | Bechett | 75/84 |
| 1,820,998 | 9/1931 | Bechett | 75/84 |
| 3,579,328 | 5/1971 | Aas et al. | 75/256 |

FOREIGN PATENT DOCUMENTS

| | | | |
|---|---|---|---|
| 50-91521 | 7/1975 | Japan | 75/134 V |
| 258348 | 12/1977 | U.S.S.R. | 75/134 V |

OTHER PUBLICATIONS

Clark, R. J. H.; *The Chemistry of Titanium Fuel Vanadium* Etsevier Publishing Co., N.Y., p. 7, (1968).

*Primary Examiner*—Michael L. Lewis
*Attorney, Agent, or Firm*—Haseltine and Lake

[57] ABSTRACT

A process for producing vanadium-containing alloys comprises the step of melting in a furnace a charge providing a content of vanadium oxides in a melt from 25 to 30 wt. % of vanadium oxides, and calcium oxides. The melt is discharged from the furnace into a receptacle in which vanadium is reduced from oxides thereof with liquid or solid silicon-containing reducing agent. Then vanadium oxides and calcium oxides are additionally introduced to oxides the residual silicon, or from 1 to 10 wt. % of vanadium oxides remain in the slag, and vanadium is reduced from these oxides in another receptacle. The process permits to reduce the production cost of the alloy, increase the vanadium content in the alloy to 80 wt. % and lower the carbon content to 0.03 wt. % and less.

5 Claims, No Drawings

PROCESS FOR PRODUCING VANADIUM-CONTAINING ALLOYS

This is a Rule 60 continuation of U.S. Patent Application Ser. No. 792,306, filed Apr. 29, 1977, now abandoned which in turn, is a Rule 60 continuation of U.S. Patent Application Ser. No. 554,542, filed Mar. 3, 1975, now abandoned.

The present invention relates to metallurgy, and more specifically to a process for producing vanadium-containing alloys.

At present, in alloying steel use is preferably made of ferrovanadium which is produced in an electric furnace by the silicoalumothermal method. The melting process generally comprises two stages: reduction and refining. After the reduction of vanadium from oxides thereof, first an alloy containing up to 35 wt.% of vanadium and 9–12 wt.% of silicon is obtained, then slag containing about 0.35 wt.% of vanadium oxides is drained. After the draining of slag, the alloy is refined in the same furnace after adding thereto vanadium pentoxide and lime. Thus, ferrovanadium is produced containing from 35 to 50 wt.% of vanadium, from 0.5 to 0.7 wt.% of carbon and up to 2 wt.% of silicon, as well as slag containing up to 14 wt.% of vanadium oxides to be used in a charge for a next melting cycle.

However, when using this method, vanadium is reduced from oxides thereof concurrently with the melting of the charge so that difficulty reducible lower vanadium oxides are formed which are bound into silicates, from which vanadium can be reduced only with difficulty as well. In addition, the reduction of vanadium takes place only at the metal-slag interface. This metal-slag interface has an insufficient surface area so that the reduction reaction proceeds at a low rate.

Due to a long residence time of the metal being reduced in an electric furnace and its contact with the electrodes an alloy thus obtained has a high content of carbon. Average temperature in the furnace reaches 1650° C. because both melting of the charge and reduction of vanadium from oxides thereof concurrently take place in the furnace. This temperature is insufficient to obtain an alloy containing more than 50 wt.% of vanadium.

Furthermore, slags deleterious to the lining are formed in the furnace during the reduction of vanadium from oxides thereof.

Known in the art is an alumothermal non-furnace method of producing vanadium-containing alloys. This method permits obtaining alloys containing up to 80 wt.% of vanadium and up to 0.1 wt.% of carbon.

This method requires, however, to use expensive vanadium pentoxide and high-grade aluminium with a low content of impurities. This method is deficient in a low productivity inherent in all non-furnace aluminothermal processes, and the resulting alloy is costly due to such a low productivity. In addition, a low degree of vanadium extraction into the alloy also contributes to a high cost of the resulting alloy.

A growing demand for vanadium-containing alloys for alloying steel and low-carbon alloys with high percentage of vanadium poses the problem of the provision of an economically reasonable and highly productive process for producing such alloys.

The main object of the invention is to provide a process for producing vanadium-containing alloys containing more vanadium than with known silicothermal processes for producing alloys in electric furnaces.

Another not least important object of the invention is to reduce the production cost of said alloy.

An important object of the invention is also to reduce the content of carbon in said alloy from 0.03 wt.% to 0.005 wt.%.

Still another object of the invention is to prolong the service life of the furnace lining and to improve the productivity of the furnace used to melt a charge for said alloy due to the reduction of vanadium from oxides thereof in a melt outside the furnace.

These and other objects are accomplished by the provision of a process for producing vanadium-containing alloys comprising the steps of melting in a furnace a charge containing vanadium and calcium oxides and reducing vanadium from oxides thereof in a melt with silicon, wherein, according to the invention, the process comprises melting a charge ensuring the content of vanadium oxides in the melt from 25 to 35 wt.%, discharging said melt from the furnace into a receptacle, and reducing vanadium with silicon in said receptacle by adding silicon in an amount sufficient to reduce vanadium from the oxides thereof contained in said melt.

The extrafurnace reduction of vanadium from oxides thereof provides for a lower carbon content in the resulting alloy which is from 0.005 to 0.03 wt.% due to the elimination of a contact of the reduced melt with the furnace electrodes.

Where vanadium is reduced from oxides thereof in a melt, rather than in a solid charge, the rate of reduction is increased, and the content of vanadium in the resulting alloy is also increased.

Since the furnace is used only to melt the charge, and the reduction is effected outside the furnace, vanadium oxides are present in a single valency state only, and namely in the form of $V_2O_5$ along with calcium oxides, whereby the furnace lining is not damaged.

We have found that the melt containing the above-specified quantities of vanadium oxides is the optimal one. A charge providing a content of vanadium oxide in a melt of less than 25 wt.% is high-melting so that the electric power consumption for melting the charge is increased. Where the content of vanadium oxides in a melt is more than 25 wt.%, the heat capacity of the melt becomes sufficient for effecting the reduction.

The reducing agent may be added to the melt in the molten state.

As a result, during the melting, solid materials may be added to the melt, such as wastes produced during the casting of the alloy, and if necessary, iron may be added so as to increase the yield of the alloy or to modify its composition.

The above-specified reducing agent may be added to the melt in the form of lumps of a size not exceeding 80 mm. The heat released during the reduction is sufficient to melt the reducing agent and to ensure a high rate of reduction with the above-specified size of lumps.

Vanadium is preferably reduced from oxides thereof in the melt to obtain slag containing from 1 to 10 wt.% of vanadium oxides, whereafter the slag is drained into another receptacle, and vanadium is reduced in that receptacle from oxides thereof in this slag.

Thus, the content of vanadium in the slag to be disposed of may be lowered to 0.5 wt.% and lower.

During the reduction of vanadium from oxides thereof additional amount of vanadium oxides are preferably added to said melt sufficient to oxidize the residual silicon.

This permits to reduce the content of silicon in the alloy and to improve the yield of the final product.

A charge containing vanadium oxides may comprise vanadium convertor slag preliminarily calcinated with carbon at from 900° to 1000° C. from which iron is withdrawn during the melting.

Enriched convertor slag is less expensive than vanadium pentoxide, but the content of vanadium in the resulting alloy will be somewhat lower when using such slag.

The invention will now be described with reference to specific embodiments of the process.

EXAMPLE 1

The process comprised melting in a furnace a charge providing for obtaining a melt containing 30 wt.% of vanadium pentoxide, as well as calcium oxides (lime).

The melt was poured from the furnace into a ladle, wheighed, and then 350 kg of liquid ferrosilicon containing 75 wt.% of silicon were added per 2 tons of the melt. Subsequently 200 kg of a mixture containing vanadium pentoxide and 100 kg of metal scrap were added to the melt.

535 kg of ferrovanadium were thus obtained containing about 70 wt.% of vanadium and 0.015 wt.% of carbon. Slag contained less than 1.0 wt.% of vanadium oxides.

EXAMPLE 2

A melt of vanadium oxides and lime was poured into a ladle from a furnace. 320 kg of liquid ferrosilicon per 2 tons of vanadium pentoxide melt were added to obtain an alloy containing 58 wt.% of vanadium, 0.02 wt.% of carbon, and slag containing 5 wt.% of vanadium oxides. This slag was poured into another furnace, which has been used to melt ferrosilicon. In this furnace ferrosilicon was obtained containing 1 wt.% of vanadium and slag containing less than 0.3 wt.% of vanadium oxides. The resulting ferrosilicon was used for reducing vanadium during the next melting cycle.

EXAMPLE 3

The process was conducted as described in Example 1, but liquid ferrosilicon was replaced by solid crushed ferrosilicon of a particle size not exceeding 50 mm.

EXAMPLE 4

400 kg of ferrosilicon containing 75 wt.% of silicon were added per 2 tons of melt to obtain 490 kg of an alloy containing 75 wt.% of vanadium and 4.2 wt.% of silicon. Slag was then drained, and a mixture containing vanadium pentoxide and lime was added to the metal. As a result of reaction of the mixture and metal, the content of silicon in the metal was lowered to 1 wt.%.

EXAMPLE 5

300 kg of ferrosilicon were added per 2 tons of melt; ferrosilicon being used in lumps of a size up to 80 mm. Thus, slag containing up to 8 wt.% of vanadium oxides was obtained to be used for producing ferrovanadium by the silicothermal method in an electric furnace, and ferrovanadium containing 57 wt.% of vanadium and 0.01 wt.% of carbon.

There it is desired to obtain alloys containing chromium, manganese, nickel, tungsten, molybdenum, niobium in addition to vanadium, products containing oxides of such metals may be also added to the charge.

In addition to the above examples, a charge providing the content of vanadium oxides in the melt from 25 to 35 wt.% may also be melted. In that case, the content of the silicon reducing agent should be either greater than that given in Example 1, when more than 30 wt.% of vanadium oxides are formed in the melt, or smaller than that given in Example 1, when less than 30 wt.% of the reducing agent are formed in the melt.

The amount of the reducing agent is calculated by the reaction $$2V_2O_5+5Si=4V+5SiO_2$$

in the stoichiometric ratio.

The effective utilisation of silicon in the reducing agent is 100%.

In accordance with the process of the invention vanadium is recued from oxides thereof in the melt to obtain slag containing from 1 to 10 wt.% of vanadium oxides, whereafter the slag is drained into another receptacle, and vanadium is reduced from oxides thereof in that receptacle in this slag.

A charge containing vanadium oxides comprises vanadium convertor slag preliminarily calcinated with carbon at from 900° to 1000° C., iron being eliminated from the slag during the melting.

What is claimed is:

1. A process for producing vanadium-containing alloys comprising the steps of melting in an electric furnace a charge containing vanadium pentoxide, vanadium converter slag preliminarily calcined with carbon, or mixtures thereof, and calcium oxide, in an amount providing the content of vanadium pentoxide in the melt of from 25 to 35 wt.%; discharging from said furnace said melt into a receptacle; adding to said melt a reducing agent containing silicon in an amount sufficient to reduce the vanadium pentoxide contained in said melt.

2. A process according to claim 1, wherein said reducing agent is added to said melt in a solid state with a size of lumps not exceeding 80 mm.

3. A process according to claim 1, wherein in the reduction of the vanadium pentoxide a slag is obtained containing from 1 to 10 wt.% of vanadium oxides, whereafter the slag is drained into another receptacle, and vanadium oxides in the slag are reduced in that receptacle.

4. A process according to claim 1, wherein, during the reduction of vanadium from oxides thereof, an additional amount of solid vanadium oxides is added to said melt sufficient to oxidise the residual silicon.

5. A process according to claim 1, wherein the vanadium converter slag is preliminarily calcined with carbon at from 900° to 1000° C., to remove the iron from the slag.

* * * * *